US006154187A

United States Patent [19]

Kim

[11] Patent Number: 6,154,187

[45] Date of Patent: Nov. 28, 2000

[54] APPARATUS FOR PROCESSING VIDEO DATA IN AC TYPE PLASMA DISPLAY PANEL SYSTEM

[75] Inventor: Se-Yong Kim, Seoul, Rep. of Korea

[73] Assignee: Daewoo Electronics Co., Ltd., Seoul, Rep. of Korea

[21] Appl. No.: 09/220,692

[22] Filed: Dec. 24, 1998

[30] Foreign Application Priority Data

Dec. 24, 1997 [KR] Rep. of Korea ..... 97-73201

[51] Int. Cl.[7] ..... G09G 3/28

[52] U.S. Cl. ..... 345/60; 345/205; 345/206

[58] Field of Search ..... 345/60, 61, 62, 345/63, 64, 65, 66, 67, 68, 69, 205, 206, 207, 209, 210

[56] References Cited

U.S. PATENT DOCUMENTS

| | | | |
|---|---|---|---|
| 4,087,805 | 5/1978 | Miller | 340/324 |
| 5,491,496 | 2/1996 | Tomiyasu | 345/147 |
| 5,926,154 | 7/1999 | Hirono et al. | 345/5 |
| 6,046,737 | 4/2000 | Nakamura | 345/213 |

FOREIGN PATENT DOCUMENTS

| | | |
|---|---|---|
| 0 833 300 | 4/1998 | European Pat. Off. . |
| 2 738 654 | 3/1997 | France . |
| 2 739 480 | 4/1997 | France . |

*Primary Examiner*—Richard A. Hjerpe
*Assistant Examiner*—Jean E. Lesperance
*Attorney, Agent, or Firm*—Pillsbury Madison & Sutro LLP

[57] ABSTRACT

A data processing apparatus of an alternating current type plasma display panel system is disclosed. A plasma panel is divided into four subpanels by dividing vertically and horizontally, and 4 data interfacing sections take charge of driving the 4 subpanels, respectively. Numbers of upper and lower address electrodes are P. Each of the four data interfacing sections repeatedly receives N bits red-green-blue (RGB) data S times from a frame memory and, after storing a horizontal line RGB data, transfers D bits RGB data a time into 4 driving IC sections for driving address electrodes in a suitable order for data processing. Each of two driving IC sections for upper right and lower right subpanels takes charge of driving R address electrodes, and each of two driving IC sections for upper left and lower left subpanels takes charge of driving P-R address electrodes, where the number R can be decided by an equation, R=N× [floor(P/N)]/2 and the operator floor(x) means a maximum integer which is not larger than the parameter x. Each of two data interfacing sections for upper right and lower right subpanels repeatedly receives the N bits RGB data floor{ [floor(P/2)]/2} times from the frame memory, and each of two data interfacing sections for the upper left and lower left subpanels repeatedly receives the N bits RGB data S−floor{ [floor(P/2)]/2} times from the frame memory. Accordingly, data interfacing chips for right subpanels and left subpanels can have an identical logic.

5 Claims, 3 Drawing Sheets

FIG. 3

| | | B1 | B4 | B3 | B2 | B3 | B2 | B1 | B4 | B2 | B1 | B4 | B3 | |
|---|---|---|---|---|---|---|---|---|---|---|---|---|---|---|
| | SFT1 | IC1_1 | IC1_1 | IC1_2 | IC1_3 | IC1_1 | IC1_2 | IC1_3 | IC1_3 | IC1_1 | IC1_2 | IC1_2 | IC1_3 | IC1 |
| | SFT2 | IC1_4 | | | | | | | | | | | | IC1 |
| | SFT3 | IC1_7 | | | | | | | | | | | | IC1 |
| | SFT4 | IC1_10 | | | | | | | | | | | | IC1 |
| INTER_U1 | SFT5 | IC1_13 | IC1_ | IC1_ | IC1_ | IC1_ | IC1_ | IC1_ | IC1_ | IC1_ | IC1_ | IC1_ | IC1_ | IC1 |
| INTER_U3 | SFT6 | IC1_16 | IC1_16 | IC3_ | IC3_ | IC1_ | IC3_ | IC3_ | IC3_ | IC1_ | IC3_ | IC3_ | IC3_ | IC1/3 |
| | SFT7 | IC3_ | IC3_ | IC3_ | IC3_ | IC3_ | IC3_ | IC3_ | IC3_ | IC3_ | IC3_ | IC3_ | IC3_ | IC3 |
| | | | | | | | | | | | | | | |
| | | | | | | | | | | | | | | |
| | SFT52 | IC19_10 | IC19_10 | IC19_11 | IC19_12 | IC19_10 | IC19_11 | IC19_12 | IC19_12 | IC19_10 | IC19_11 | IC19_11 | IC19_12 | IC19 |
| | SFT53 | IC19_13 | IC19_13 | IC19_14 | IC19_15 | IC19_13 | IC19_14 | IC19_15 | IC19_15 | IC19_13 | IC19_14 | IC19_14 | IC19_15 | IC19 |
| | SFT54 | IC19_16 | IC19_16 | IC21_1 | IC21_2 | IC19_16 | IC21_1 | IC21_2 | IC21_2 | IC19_16 | IC21_1 | IC21_1 | IC21_2 | IC19 /21 |
| | SFT55 | IC21_3 | IC21_3 | IC21_4 | IC21_5 | IC21_3 | IC21_4 | IC21_5 | IC21_5 | IC21_3 | IC21_4 | IC21_4 | IC21_5 | IC21 |
| INTER_U2 | | | | | | | | | | | | | | |
| INTER_U4 | | | | | | | | | | | | | | |
| | SFT106 | | | | | | | | | | | | | IC39 |
| | SFT107 | | | | | | | | | | | | | IC39 |

300

LEGEND : (1) IC#–# ← OUTPUT ORDER FROM DATA INTERFACE TO DATA DRIVNG IC

SERIAL NUMBER OF DATA DRIVING IC (2) B# ← INPUT PIN NUMBER FOR DRIVING IC (3) SFT# ← SHIFT SIGNAL NUMBER FOR CONTROLLING DATA INPUT FROM MEMORY TO DATA INTERFACE

APPARATUS FOR PROCESSING VIDEO DATA IN AC TYPE PLASMA DISPLAY PANEL SYSTEM

BACKGROUND OF THE INVENTION

1. Field of the Invention

The present invention relates to a flat panel display apparatus and, more particularly, to a video data processing apparatus for driving address electrodes of a flat panel display system which uses a red-green-blue(RGB) strip type plasma display panel.

2. Description of the Prior Art

Customers of television sets have demanded slim display apparatus which have wide screen. Since existing cathode ray tube (CRT) equipments have started reveal limitations in fulfilling such a demand, they are replaced by a so-called flat panel display (FPD) apparatuses that has a wide and slim display area. Further, many research projects in FPD field are globally in process.

The FPD apparatus is largely divided into an emissive device and a non-emissive device. The emissive device, usually called an active emitting device, is a device which emits a light by itself. Typical examples of the emissive devices are a field emission display (FED) device, a vacuum fluorescent display (VFD) type device, an electro-luminescence (EL) type device, a plasma display panel (PDP) and the like. The non-emissive device is called a passive light emitting device, and there are examples of the non-emissive device such as a liquid crystal display (LCD) device, an electro-chromic display (ECD), an electro-phoretic display (EPID) and the like.

Currently, the LCD device occupies a main stream of production in electric and electronis goods such as desk clocks, calculators, lap-top computers and the like. Although this device can be adopted to television sets having a screen size of more than 21 inches, it has also shown the limitations in manufacturing process of panels and in obtaining satisfiable products. Further, it has problems of having a narrow visual field angle and a response rate varies subject to a temperature change. Due to a capability of solving these problems of the LCD device, the PDP newly attracts public attention as a next generation FPD.

Since, in principle, the PDP emits a light by itself similarly to that of a fluorescent lamp, it has uniform brightness and a high contrast although a screen area of the PDP is as wide as a screen area of the CRT. In addition, the PDP has a visual field angle of more than 140 degrees and above, and is well-known as the best and widest screen display device which has a screen size of 21 to 55 inches. The panel manufacturing process of the PDP is simplified as compared with that of the LCD device and thereby saves a manufacturing cost. However, because the manufacturing cost of the PDP is more expensive than that of the CRT, manufacturers have sought to reduce the manufacturing cost.

The plasma display is largely classified as a direct current (DC) type and an alternating current (AC) type according to a structural difference of a discharge cell thereof and a form of a driving voltage based on the structural difference. The DC type is driven by a DC voltage whereas the AC type is driven by a sinusoidal AC voltage or by a pulse voltage. The AC type includes such a structure that a dielectric layer covers an electrode to be served as a current regulation resistor. On the other hand, the DC type includes such a structure that an electrode is exposed to a discharge room as it is and a discharge current comes to flow during a supply of the discharge voltage. Because the AC type has the electrode which is covered with the dielectric, it is more durable than the DC type. The AC type has a further advantage in that a wall electric charge which is generated on a surface of the dielectric as a result of a polarization causes the cell to have a memory function therein, and is more applicable than others in the field of display devices.

A color PDP includes a structure of three terminals wherein a special electrode is installed in order to improve discharge characteristics thereof. Namely, the 3-terminal structure comprises three electrodes per unit cell for a display which are an address electrode for entering data, a maintenance electrode for sequentially scanning a line and for maintaining a cell discharge, and a bus electrode for helping a discharge maintenance.

A number of the address electrode for entering data is determined in accordance with a horizontal resolution. For example, in a case where samples of the red, green and blue colors per line are 853, a total number of the samples amounts to 2559. Therefore, a required number of the address electrodes is also 2559. In a case where an arrangement of the address electrode has a strip form, red, green and blue electrodes are arranged repeatedly.

As described above, because a circuit arrangement of an electrode driving section is restricted to a consideration of a space utilization when thousands of the address electrodes are arranged on one side, an upper and lower electrode driving system is adapted wherein section for driving 1280 electrodes, which are ordered in an odd-numbered sequence, are arranged at an upper end portion of a panel whereas section for driving 1279 electrodes, which are ordered in an even-numbered sequence, are arranged at a lower end portion thereof (refer to U.S. Pat. No. 4,695,838).

Meanwhile, in order to display a TV signal of a system of national television system committee (NTSC) on the PDP, a data processing section converts an interlaced scanning system into a sequential scanning system, and also converts data into data of a subfield system for a PDP contrast-processing. Further, the data processing section provides 1280 RGB pixel data per line to the electrode driving section for driving the upper and lower address electrodes of the panel of the PDP in harmony with the arrangement of the address electrode.

Conventionally, a video data processing section of the PDP includes a data rearranging section for rearranging digital RGB sample data into subfield data for the contrast-processing, a frame memory section for converting one scanning system into the other, a data interfacing section, and a timing control section.

A composite video signal received through an antenna is processed into an analog signal by a video/audio signal processing section, and the analog signal is converted into a digital video signal by an analog-to-digital converting section. This digital video signal is transferred in turn through the data rearranging section, the frame memory section and the data interfacing section to an address electrode driving section of a data stream type which is suitable for contrast-processing of the PDP. For suitable timing-controls to respective sections, the timing controlling section generates timing control signals for respective sections by frequency-dividing a main clock signal.

In a PDP-TV, each field is usually divided into multiple subfields for displaying a contrast of each pixel. Respective subfields are processed through the three steps: an entry and elimination of a whole screen, an entry of data, and maintenance of a discharge. It takes 1.44 ms for contrast-processing of one frame. In order to scan 480 lines during 1.44 ms, 3 $\mu$s can be allotted for scanning one line. Accordingly, 2559(853× 3(RGB)) pixel data of one line should be processed during 3$\mu$s. If 24 bits(8 bits×3(RGB)) pixel data per one time are transferred from the frame memory section to the data interfacing section, 24 bits data shift should be repeated 107 times for transferring one line pixels data. Considering a margin, the PDP-TV capable of repeating 150 times is recommendable.

When a resolution of the PDP is 3×853×480, a main clock frequency should be 50 MHz (20 ns) for controlling data shifts of 150 times during 3 $\mu$s. Consequently, to generate various timing control signals, the timing controlling section should count 50 MHz main clock during one vertical sync time. Since the vertical sync time is 16.67 ms in the NTSC-TV system which displays 60 fields per second, a 20 bits counter is necessary for counting the 50 MHz main clock.

Employing a high bits counter may results in glitches upon decoding output data because outputs from higher significant bits of the counter are skewed. Synchronizing whole outputs of the counter for reduced output skews causes a logic of the counter to be complicated.

In another prior art to resolve this problem, a plasma panel is vertically and horizontally divided into four subpanels, and four data interfacing sections and the four subpannels are connected one-to-one. However, if no special considerations are applied to this four subpanels way, four different kinds of data interfacing sections which are not compatible with one another should be employed. This fact will result in an increase of system complexity.

SUMMARY OF THE INVENTION

Therefore, in order to settle the problems of the prior art as described above, it is an object of the present invention to provide a data processing apparatus of a flat panel display system wherein when four data interfacing sections are respectively allotted to four subpanels, left and right data interfacing sections of upper and lower subpannels have identical logic each other and are compatible each other.

In order to achieve the above object, the present invention provides an apparatus for processing a red-green-blue (RGB) data which is used for driving P upper address electrodes and P under address electrodes of an alternating current (AC) type plasma display panel after receiving the RGB data from a frame memory means, comprising:

a driving means for driving the P upper address electrodes and P under address electrodes; and a data interfacing means for transferring one horizontal line RGB data to the driving means in an order consistent with a data processing order of the driving means after repeatedly receiving a N bits RGB data S times, where an N×S bits RGB data forms the one horizontal line RGB data, from the frame memory means, wherein the driving means includes first, second, third and fourth driving sections assigned to upper right, upper left, lower right and lower left address electrodes, respectively, each of the first and third driving sections charges takes charge of driving R address electrodes, and each of the second and fourth driving sections charges driving of P-R address electrodes, where R is calculated by an equation, R=N×[floor(P/N)]/2, and an operator floor(x) means a maximum integer which is not larger than the parameter x, wherein the data interfacing means includes first, second, third and fourth data interfacing sections which are assigned to the first, second, third and fourth driving sections respectively, the first and second data interfacing sections are compatible with each other, the third and fourth data interfacing sections are compatible with each other, each of the first and third data interfacing sections repeatedly receives the N bits RGB data floor{[floor(P/2)]/2} times, and each of the second and fourth data interfacing sections repeatedly receives the N bits RGB data S−floor{[floor(P/2)]/2} times.

BRIEF DESCRIPTION OF THE DRAWINGS

The above object and other advantages of the present invention will become more apparent by describing in detail preferred embodiments thereof with reference to the attached drawings, in which:

FIG. 3 is a data interfacing map for explaining the embodiment of the present invention.

DESCRIPTION OF THE PREFERRED EMBODIMENTS

Hereinafter, a preferred embodiment of the present invention will be explained in more detail with reference to the accompanying drawings.

Figure 1:
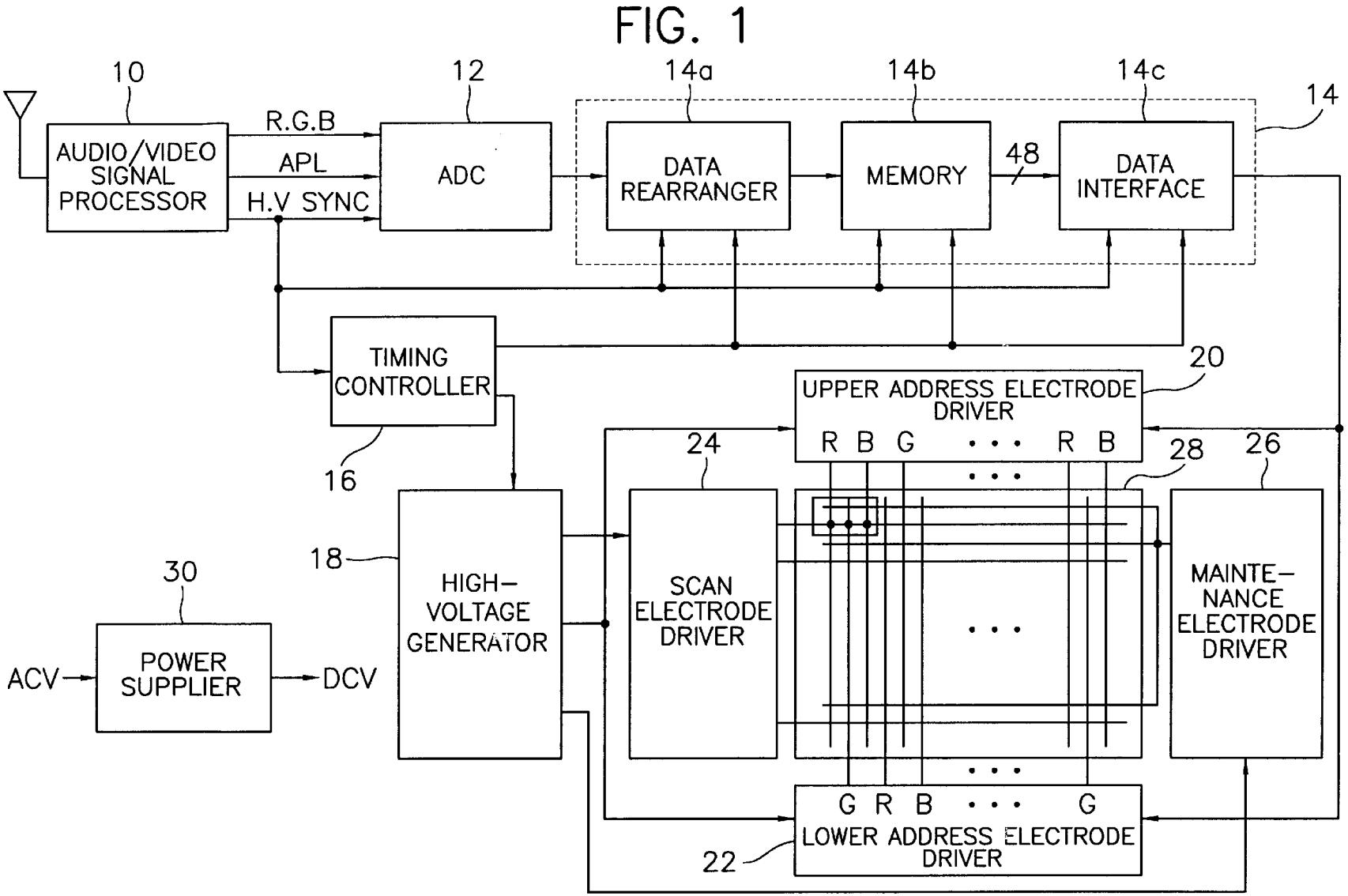
FIG. 1 is a block diagram showing a circuit configuration of a PDP-TV.

Referring to FIG. 1, a PDP-TV includes a video processing section for converting an NTSC composite video signal into a signal form which is adapted to the PDP-TV system and a driving circuit section for displaying processed video data through a panel thereof.

Broadly speaking, a composite video signal which is received through an antenna is analog-processed by an audio/video (A/V) signal processing section 10, and an analog-processed signal is then digitized to a prescribed video data by an analog-to-digital converter (ADC) 12. Afterwards, while passing through a data rearranging section 14*a*, a frame memory section 14*b* and a data interfacing section 14*c* of a data processing section 14, the video data are converted into a data stream which is adapted to a contrast-processing characteristic of the PDP, and then a converted data stream is then provided to upper and lower address electrode driving sections 20 and 22.

Under the control of a timing controller 16, a high-voltage generating section 18 provides a high-voltage control pulse which is required by upper address electrode driving section 20, lower address electrode driving section 22, a scan electrode driving section 24 and a maintenance electrode driving section 26, and a power supplying section 30 inputs an AC voltage to produce all DC voltages which are required by a whole system.

A/V signal processing section 10 inputs the NTSC composite video signal to separate an analog RGB and a horizontal or vertical synchronizing signal (H,V SYNC), and produces an average picture level (APL) which corresponds to an average value of a luminance signal to ADC 12 and which is then provided to ADC 12.

The interlaced scanning system is adopted for the NTSC composite video signal whose one frame consists of two fields of even- and odd-numbered sequences, and whose horizontal and vertical synchronizing signals have frequencies of 15.73 [KHz] and 60 [Hz], respectively. An audio signal which is separated from the composite video signal is directly provided to a speaker via an audio amplifier.

ADC 12 inputs the analog RGB signal to convert the inputted analog RGB signal into digital data, and provides the converted digital data to data processing section 14. Here, the digital data is video data whose signal form is converted for improving brightness of the PDP-TV system. ADC 12 amplifies the analog RGB signal and the APL signal for having signal levels thereof which are adapted to quantization, and converts the vertical and horizontal synchronizing signals for having prescribed phases thereof. Also, ADC 12 generates a clock by using a phase-locked loop (referred to as "PLL") in order to use a sampling clock as a synchronized clock with an input synchronizing signal.

The PLL compares a phase of a variable pulse from a loop with a phase of an input synchronizing signal, and provides a synchronized clock with the input synchronizing signal. In a case where the clock which is not synchronized with the input synchronizing signal is used, a vertical linearity of a picture to be displayed is not ensured.

Also, ADC 12 sets vertical and horizontal positions of a sampling area. In a vertical position section, only lines which include the video signal among the input signals are set. In a horizontal position section, only time which includes the video signal among the lines which is set to the vertical position is set. Both the vertical position section and the horizontal position section are a reference for a sampling. As illustrated in Table 1, a total of 480 lines is selected in 240 lines of units for the vertical position section. The horizontal position section has to correspond to a time interval in which at least 853 sampling clocks can exists per line.

Also, ADC 12 maps the RGB data to data which coincides with a brightness characteristic of the PDP and outputs a mapped RGB data. That is, ADC 12 includes a read only memory (ROM) which has a plurality of vector tables recorded therein, and then maps an optimal vector table read from ROM 1 to 1 in accordance with a digitized APL data in order to provide an improved form of RGB data to data processing section 14.

TABLE 1

| | 1 frame | | |
|---|---|---|---|
| items | odd | even | remarks |
| total lines | 1H-262.5H | 262.5H-525H | NTSC TV |
| active lines | 22H-263H | 284H-525H | |
| selective lines | 23H-262H | 285H-524H | |

In order to process the contrast of the PDP, data rearranging section 14*a* of data processing section 14 is required to reconfigure the video data into a plurality of subfields, and then to rearrange data bits from the most significant bit (MSB) to the least significant bit (LSB). Data rearranging section 14*a* performs rearrangement so that the video data provided in parallel may be stored at a location specified by an address of a frame memory as bits having the same weight.

Here, in order to distinguish data for the upper address electrode from data for the lower address electrode, there is configured one word in which among respective 8 1-bit data with respect to rearranged red and blue, 4 1-bit data in an odd-numbered sequence are placed at an upper bit while 4 1-bit data in an even-numbered sequence are placed at a lower bit, and in which among 8 1-bit data with respect to a rearranged green, four one-bit data in an odd-numbered sequence are placed at a lower bit while 4 1-bit data in an even-numbered sequence are placed at an upper bit.

Because frame memory section 14*b* of data processing section 14 divides one field into eight subfields for the contrast-processing of the PDP, and reads in series the video data corresponding to the respective subfields in harmony with an arrangement order of the electrodes to provide the read video data to data interfacing section 14*c*, reading order is quite different from writing order from a structure aspect.

Data interfacing section 14*c* rearranges the RGB data from frame memory section 14*b* in harmony with an arrangement of an RGB pixel of a display section 28 and provides the rearranged RGB data to an address driving integrated circuit (IC). Data interfacing section 14*c* provisionally stores the RGB data from frame memory section 14*b* and then provides read RGB data respectively to upper and lower address electrode driving sections 20 and 22 in a data form which is required by upper and lower address electrode driving sections 20 and 22.

High-voltage generating section 18 combines the DC high-voltages in accordance with a control pulse having various logic levels from timing controller 16, and produces the high-voltage control pulse which is required by upper address electrode driving section 20, by lower address electrode driving section 22, by scan electrode driving section 24 and by maintenance electrode driving section 26, and which enables the PDP to be driven. Upper and lower address electrode driving sections 20 and 22 adequately raise a voltage level of the data from data interfacing section 14*c*, and a selective entry can be executed into display section 28.

A driving method for the contrast-processing of the PDP according to the present invention, divides one field into a plurality of subfields, i.e., 256 contrast-8 subfields, and enters the video data corresponding to respective subfields by the line into display section 28 via upper and lower address electrode driving sections 20 and 22. The method sets a number of discharge maintenance pulses to a smaller one in an order starting from a subfield having MSB data entered therein to the subfield having LSB data entered therein, and performs the contrast-processing on the basis of a total discharge maintenance period according to a combination therebetween.

Upper and lower address electrode driving sections 20 and 22 include 20 driving ICs which have both 4-bit input pins and 64-bit output pins. Thus, respective driving sections load the data corresponding to one line alternately in an even or odd order over 32 times in total in 40 units from data interfacing section 14*c*, and then drives one line of electrodes simultaneously.

The same data is displayed twice in even and odd fields and thereby eliminates a flickering which accompanies a non-interlacing scan. A driving order of the divided subfields is described as follows.

1) Entry and elimination of a whole screen

In order to eliminate a wall electric charge which remains at a selected pixel after a discharge maintenance of a previous subfield, the wall electric charge is entered a whole pixel for a short time which is not enough to be visible, and the whole pixels are then eliminated to remove all of the remaining wall electric charges and to initialize the whole pixels.

2) Entry of data

While shifting a scan pulse in sequence at a scan electrode, a relevant data is entered by the line through an address electrode, and thereby forming the wall electric charge at a pixel which is intended to be discharged.

3) Maintenance of a discharge

The discharge of a pixel having the wall electric charge which is formed therein while alternately applying the maintenance pulse between the maintenance electrode and the scan electrode is initiated and is then maintained. At this time, because there is such a possibility that a peripheral pixel, which is entered, influences another pixel, which is not entered, to produce an erroneous discharge, elimination of a narrow range is performed every time after applying the maintenance pulse, and a correct discharge is then performed. A time for maintenance of a discharge can vary according to weight of respective subfields.

Figure 2:
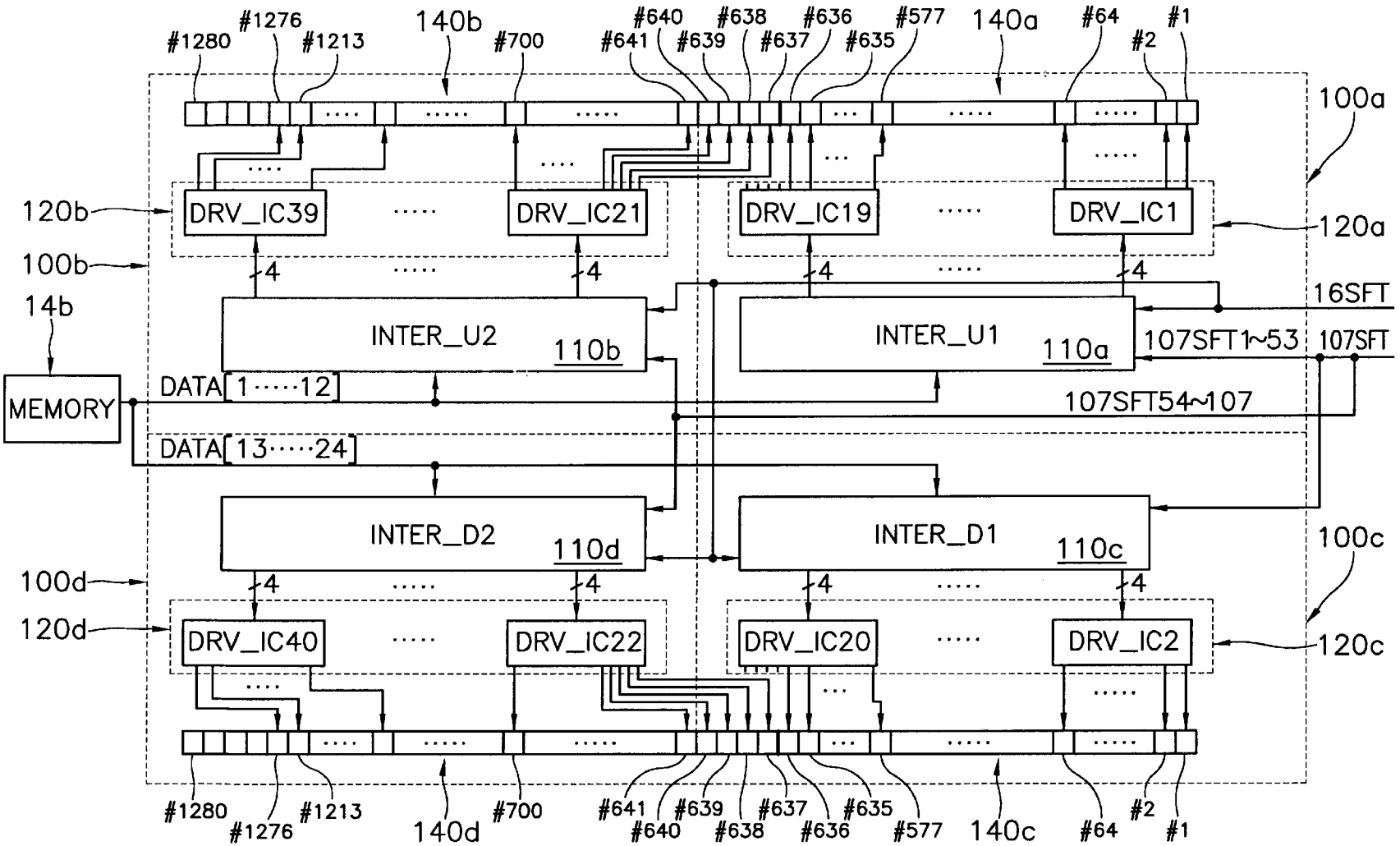
FIG. 2 is a connection diagram of address electrodes, address electrode driving integrated circuit (IC) chips and data interfacing chips according to an embodiment of the present invention for driving four segmented subpanels.

FIG. 2 illustrates a connection diagram of address electrodes, address electrode driving integrated circuit (IC) chips and data interfacing chips viewed from a rear of plasma panel 28 when separately driving four segmented subpanels.

The plasma panel 28 is vertically and horizontally segmented. An upper panel including upper right and upper left subpanels 100*a* and 100*b* has 1280 address electrodes. A lower panel including lower right and lower left subpanels 100*c* and 100*d* has also 1280 address electrodes.

Upper address electrode driving section 20 for driving address electrodes of upper panel 100*a*+100*b* includes odd-numbered 20 driving IC chips (DRV_IC1, DRV_IC3, DRV_IC39). Lower address electrode driving section 22 for driving address electrodes of lower panel 100*c*+100*d* also includes even-numbered 20 driving IC chips (DRV_IC2, DRV_IC4, . . . , DRV IC40).

Odd-numbered driving IC chips (DRV_IC1, DRV_IC3, . . . , DRV_IC39) for upper panel 100*a*+100*b* are divided into two groups: upper right driving IC section 120*a* for address electrodes 140*a* of upper right subpanels 100*a* and upper left driving IC section 120*b* for address electrodes 140*b* of upper left subpanels 100*b*. In the same way, even-numbered driving IC chips (DRV_IC2, DRV_IC4, . . . , DRV_IC40) for lower panel 100*c*+100*d* are also divided into two groups: lower right driving IC section 120*c* for address electrodes 140*c* of lower right subpanels 100*c* and lower left driving IC section 120*d* for address electrodes 140*d* of lower left subpanels 100*d*. Accordingly, each of four driving IC sections 120*a* to 120*d* includes 10 driving IC chips.

Four driving IC sections 120*a* to 120*d* are connected to four data interfacing sections 110*a*, 110*b*, 110*c* and 110*d*, respectively. Frame memory 14*b* is connected to four data interfacing sections 110*a*, 110*b*, 110*c* and 110*d*, respectively.

Meanwhile, each of the driving IC chips DRV_IC1, DRV_IC2, . . . , DRV_IC39 and DRV_IC40 has 64 output pins and the output pin and the address electrode are connected one-to-one. Consequently, a maximum number of address electrodes that each of the four driving IC sections 120*a* to 120*d* can charge is 640. Here, according to the embodiment of the present invention, upper right driving IC section 120*a* charges driving of first to $636^{th}$ address electrodes of upper panel 100*a*+100*b*. Last four output pins of $10^{th}$ driving IC chip DRV_IC19 of upper right driving IC section 120*a* are not used. However, all the 640 output pins of upper right driving IC section 120*b* are used for driving $647^{th}$ address electrode to $1276^{th}$ address electrode. By performing this way, last four address electrodes, from $1277^{th}$ to $1280^{th}$ address electrodes, of upper left panel 100*b* can not be driven. In order to drive the last four address electrodes without loss, an additional driving IC chip should be added to upper left driving IC section 120*b*. As for lower panel 100*c*+100*d*, lower address electrodes 140*c* and 140*d* for lower panel 100*c*+100*d* and lower right and lower left driving IC sections 120*c* and 120*d* are connected same as the upper panel case.

Here, since the address electrode number of upper panel 100*a*+100*b* is 1280 and each of upper right and upper left driving IC sections 120*a* and 120*b* can undertake 640 address electrodes, a way that each of two driving IC sections 120*a* and 120*b* undertakes 640 address electrodes may be considered. However, this way inevitably causes a problem that upper right data interfacing section 110*a* and upper left data interfacing section 110*b* should have different logics and thus are not compatible with each other. Accordingly, such a connecting way between address electrodes 140*a* to 140*d* and driving IC sections 120*a* to 120*d* shown in FIG. 2 is necessary for the compatibility between right data interfacing sections 110*a* and 110*c* and left data interfacing sections 110*b* and 110*d*.

The reason is explained in detail referring to a data interfacing map shown in FIG. 3. Here, supposing that 12 bits data a time are shifted from frame memory 14*b* to data interfacing section 14*c*, frame memory 14*b* should repeatedly shift 12 bits RGB data 107 times to upper or lower data interfacing section for transferring one horizontal line data (1280 bits) for upper address electrodes 140*a* and 140*b*. Although a total of the shifted data is 1284 bits, the effective data are 1280 bits because the last four bits are dummy data.

For identical logic between right data interfacing sections 110*a* and 110*c* and left data interfacing sections 110*b* and 110*d* for compatibility of each other, following things should be considered when shifting RGB data from frame memory 14*b* to data interfacing section 14*c*.

The data interfacing map of FIG. 3 illustrates a case that respective data interfacing sections 110*a* to 110*d* repeatedly receive 12 bits data a time from frame memory 14*b* and repeatedly transfers 4 bits data a time into respective driving IC chips DRV_IC1 to DRV_IC40. According to the data interfacing map of FIG. 3, in order to assign exact halves of 1280 bits RGB data to upper right and upper left driving IC sections 120*a* and 120*b*, 4 bits RGB data (four IC19_16) among 12 bits RGB data 300 to be outputted from frame memory 14*b* triggered by 54th shift signal SFT54 should be provided to driving IC chip DRV_IC19 which is the last driving IC chip of upper right driving IC section 120*a* and the other 8 bits RGB data should be provided to driving IC chip DRV_IC21 which is the first driving IC chip of upper left driving IC section 120*b*. However, in order to pursue this way of data distribution, logics of upper and lower right data interfacing sections 110*a* and 110*c* inevitably should be different from those of upper and lower left data interfacing sections 110*b* and 110*d*. Accordingly, for an identical logic design between right data interfacing sections 110*a* and 110*c* and left data interfacing sections 110*b* and 110*d*, all the 12 bits RGB data 300 to be shifted by $54^{th}$ shift signal SFT54 should be transferred to either upper right data interfacing section 110*a* (or lower right data interfacing section 110*c*) or upper left data interfacing section 110*b* (or lower left data interfacing section 110*d*).

The present embodiment suggests that 12 bits RGB data 300 including the 4 bits RGB data (four IC19_16) are provided to driving IC chip DRV_IC21. According to this way, 636 bits RGB data are shifted from frame memory 14*b* to respective upper right and lower right data interfacing sections 110*a* and 110*c* by 53 shift signals (SFT1~SFT53). This is in harmony with the fact that practically each of upper right and lower right driving IC sections 120*a* and 120*c* uses 636 output pins. Each of upper left and lower left data interfacing sections 110*b* and 110*d* receives 644 bits RGB data, not including 4 bits dummy data, from frame memory 14*b* by 54 shift signals (SFT54~SFT107). Here, the 4 bits RGB data (four IC19_16) belongs to the firstly shifted 12 bits RGB data 300. In connections between address electrodes and driving IC chips shown in FIG. 2, since each of upper left and lower left driving IC sections 120*b* and 120*d* has 640 output pins, the last four bits RGB data among 644 shifted RGB data are not used for driving address electrodes but treated as invalid data. For avoiding a loss of 4 bits RGB data as described above, another driving IC chip should be added to each of upper left and lower left driving IC sections 120*b* and 120*d*.

Here, timing controlling section 16 provides output shift signal 16SFT to respective data interfacing sections 110*a* to 110*d* to control shifts of RGB data into driving IC sections 120*a* to 120*d*. Data interfacing sections 110*a* to 110*d* can receive 107 shift signals (SFT1~SFT107) from timing controlling section 16 or respective data interfacing sections can make the 107 shift signals by using the system reference clock signal supplied from timing controlling section 16. In the latter case, timing controlling section 16 should provide first to $53^{th}$ shift signals (SFT1~SFT53) among 107 shift signals and $54^{th}$ to $107^{th}$ shift signals (SFT54~SFT107) to right data interfacing sections 110*a* and 110*c* and left data interfacing sections 110*b* and 110*d*, respectively.

The above description can be generalized if numbers of upper address electrodes 140*a* and 140*b* and lower address electrodes 140*c* and 140*d* are P, and respective data interfacing sections 110*a*~110*d* repeatedly receive N bits RGB data S times from frame memory 14*b*, where an N×S bits RGB data is one horizontal line data, and shifts D bits a time to respective driving IC sections 120*a*~120*d* in a suitable order for data processing after provisionally storing. Then, right driving IC sections 120*a* and 120*c* take charge of driving R address electrodes, and left driving IC sections 120*b* and 120*d* take charge of driving P-R address electrodes. Here, the number R can be decided by a following equation, R=Nx [floor(P/N)]/2, where the operator floor(x) means a maximum integer which is not larger than the parameter x. Meanwhile, right data interfacing sections 110*a* and 110*c* repeatedly receive N bits RGB data floor{[floor (P/N)]/2} times from frame memory 14*b*, and left data interfacing sections 110*b* and 110*d* repeatedly receive N bits RGB data S−floor{[floor(P/N)]/2} times from frame memory 14*b*.

As far the general rule is compelled with as above, logics of upper right and upper left data interfacing sections 110*a* and 110*b* can be designed identically each other, and logics of lower right and lower left data interfacing sections 110*c* and 110*d* can be designed identically each other as well. Accordingly, efforts for a logic design of data interfacing chips can decrease by half because right data interfacing sections 110*a* and 110*c* and left data interfacing sections 110*b* and 110*d* are compatible with each other. Here, an internal logic of data interfacing chip can be designed in various ways.

From the above description, it can be easily analyzed that when frame memory 14*b* shifts 12 bits RGB data a time to data interfacing section 14*c*, the numbers P, N, S, D and R are 1280, 12, 107, 4 and 636, respectively. When frame memory 14*b* shifts 24 bits RGB data a time to data interfacing section 14*c*, the numbers P, N, S, D and R are 1280, 24, 54, 4 and 624, respectively.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. An apparatus for processing a red-green-blue (RGB) data which is used for driving P upper address electrodes and P under address electrodes of an alternating current (AC) type plasma display panel after receiving the RGB data from a frame memory means, comprising:

a driving means for driving the P upper address electrodes and P under address electrodes; and a data interfacing means for transferring one horizontal line RGB data to the driving means in an order consistent with a data processing order of the driving means after repeatedly receiving a N bits RGB data S times, where an N×S bits RGB data forms the one horizontal line RGB data, from the frame memory means, wherein the driving means includes first, second, third and fourth driving sections assigned to upper right, upper left, lower right and lower left address electrodes, respectively, each of the first and third driving sections charges takes charge of driving R address electrodes, and each of the second and fourth driving sections charges driving of P-R address electrodes, where R is calculated by an equation, R=N×[floor(P/N)]/2, and an operator floor(x) means a maximum integer which is not larger than the parameter x, wherein the data interfacing means includes first, second, third and fourth data interfacing sections which are assigned to the first, second, third and fourth driving sections respectively, the first and second data interfacing sections are compatible with each other, the third and fourth data interfacing sections are compatible with each other, each of the first and third data interfacing sections repeatedly receives the N bits RGB data floor{[floor(P/2)]/2} times, and each of the second and fourth data interfacing sections repeatedly receives the N bits RGB data S−floor{[floor(P/2)]/2} times.

2. The apparatus as claimed in claim 1, wherein values of P, N, S, D and R are 1280, 12, 107, 4 and 636, respectively.

3. The apparatus as claimed in claim 1, wherein values of P, N, S, D and R are 1280, 24, 54, 4 and 624, respectively.

4. The apparatus as claimed in claim 1, wherein the first, second, third and fourth driving sections include 10 driving integrated circuit chips for driving a quarter of address electrodes respectively, where output pin numbers of every driving integrated circuit chip are 64.

5. The apparatus as claimed in claim 1, wherein the first and third driving sections include 10 driving integrated circuit chips for driving half of address electrodes respectively, and the second and fourth driving sections include 11 driving integrated circuit chips for driving the other half of address electrodes respectively, where output pin numbers of every driving integrated circuit chip are 64.

* * * * *